US005610363A

United States Patent [19]

Crews et al.

[11] Patent Number: 5,610,363

[45] Date of Patent: Mar. 11, 1997

[54] ENHANCED WHIPPLE SHIELD

[75] Inventors: Jeanne L. Crews, Arcadia; Eric L. Christiansen, Houston, both of Tex.; Joel E. Williamsen; Jennifer R. Robinson, both of Huntsville, Ala.; Angela M. Nolen, Blountsville, Ala.

[73] Assignee: The United States of America as represented by the Administrator of the National Aeronautics and Space Administration, Washington, D.C.

[21] Appl. No.: 390,455

[22] Filed: Feb. 15, 1995

[51] Int. Cl.[6] ..... F41H 5/04

[52] U.S. Cl. ..... 89/36.02; 89/36.11

[58] Field of Search ..... 89/36.02, 36.11, 89/36.08; 428/911; 109/49.5, 82, 84

[56] References Cited

U.S. PATENT DOCUMENTS

| | | | |
|---|---|---|---|
| 3,286,665 | 11/1966 | Wygant et al. | 109/82 |
| 3,826,172 | 7/1974 | Dawson | 89/36.02 |
| 4,836,084 | 6/1989 | Vogelesand et al. | 89/36.02 |
| 5,067,388 | 11/1991 | Crews et al. | 89/36.02 |
| 5,102,723 | 4/1992 | Pepin | 428/911 |
| 5,200,256 | 4/1993 | Dunbar | 428/212 |
| 5,217,185 | 6/1993 | Rucker | 244/121 |

FOREIGN PATENT DOCUMENTS

| | | | |
|---|---|---|---|
| 2258924 | 2/1993 | United Kingdom | 89/36.08 |

OTHER PUBLICATIONS

"Advanced Meteoroid and Debris Shielding Concepts," Eric L. Christiansen, AIAA 90–1336, AIAA/NASA/DOD Orbital Debris Conference: Technical Issues & Future Directions, Apr. 16–19, 1990, Balitmore, MD pp. 1–14.

"Orbital Debris and Near–Earth Environmental Management: A Chronology," David S. F. Portree and Joseph P. Loftus, Jr., NASA Reference Publication 1320, Dec. 1993, pp. 1–105.

*Primary Examiner*—Stephen M. Johnson

*Attorney, Agent, or Firm*—James M. Cate

[57] ABSTRACT

A hypervelocity impact (HVI) Whipple Shield and a method for shielding a wall from penetration by high velocity particle impacts where the Whipple Shield is comprised of spaced apart inner and outer metal sheets or walls with an intermediate cloth barrier arrangement comprised of ceramic cloth and high strength cloth which are interrelated by ballistic formulae.

22 Claims, 2 Drawing Sheets

ENHANCED WHIPPLE SHIELD

ORIGIN OF THE INVENTION

The invention described herein was made by employees of the United States Government and may be manufactured and used by or for the Government of the United States of America for governmental purposes without the payment of any royalties thereon or therefor.

FIELD OF THE INVENTION

The invention relates to a hypervelocity impact (HVI) Whipple Shield and to a method for shielding a wall from penetration by high velocity particle impacts, and more particularly, to a type of Whipple Shield comprised of spaced apart inner and outer metal sheets or walls with an intermediate cloth barrier arrangement which enhances the protection of the inner wall against particle penetration.

BACKGROUND OF THE INVENTION

Protection from penetration of a wall by debris in space or particle impacts caused by collision of a particle in space with the wall of a space vehicle is a particular concern which must be addressed by designers of space vehicles. This is particularly true of manned vehicles or structures such as the space station. The parameters for protection against orbital debris or impact particles have been defined in terms of the failure of an impacting particle to penetrate a wall where the impacting particle has a critical density or mass, a relative impact velocity and relative impact angle. For a given material and spherical particle shape, the critical density or mass can be expressed as a critical diameter.

"Whipple Shields" have been widely used in space operations and elsewhere for protection against penetration of a containment wall in hypervelocity micrometeroid environment and widely proposed for protection against recently developed man-made orbital debris environment. A Whipple Shield typically consists of two spaced apart sheets of metal where one of the sheets is a front "bumper" sheet with a separation spacing from a "back sheet" which can sometimes be a containment or rear wall (pressure hull). The material of the sheets, the thickness of the sheets, the density of the material and the density of the impacting debris, the velocity and the impact angle of the imparting debris and the spacing between sheets are some of the interrelated parameters which define the protection capability against penetration for a given Whipple Shield. As can be deduced, there are design trade offs, such as weight, volume and spacing for any given protection against a given impact particle of debris. Usually, the protection necessary is determined relative to a given impact particle which is defined in terms of critical diameter, velocity and impact angle. A Whipple Shield can then be designed with an optimum spacing between the bumper (outer wall) and back wall (inner wall) for selected bumper and back wall thickness of a selected material.

With no constraints as to weight, space, or prior design configuration, there are no problems in obtaining a Whipple Shield with suitable protection capabilities for the characteristics of any given impact particle. However, the fact is that weight, volume and space are critical parameters in space operations and existing design configurations are in place for some space vehicles. Thus, there is a need to improve performance levels of existing protection systems and/or systems with severe volume constraints without materially affecting existing structural design parameters.

In terms of function, the outer bumper sheet of a Whipple Shield is penetrated by an impact particle or object having mass, velocity and impact angle relative to the bumper surface. The impact on the wall of the bumper sheet shocks the impact particle converting some of the initial particle kinetic energy to thermal energy and produces smaller particle fragments to a size (critical diameter) where the fragments do not have sufficient energy (mass, velocity and angle of impact relative to the bumper surface) to individually penetrate the back containment wall. Additionally, in the space between the bumper sheet and the containment wall, the particle fragment cloud expands to impact a larger surface area of the containment wall, thereby eliminating concentrated energetic impact of the fragments on a single point on the wall, and increasing the penetration resistance of the wall.

In existing structures such as a space station, the structural design is quite intricate with many interrelated "trade-off" of parameters and the existing designs have a "Whipple Shield" for the crew area which is designed to provide protection against hypervelocity impact matter. With increasing concerns regarding protection against the accumulating orbital debris in space and its size, it is desirable to enhance the protection capability of existing Whipple Shields without requiring expensive redesign or without significantly increasing weight.

SUMMARY OF THE INVENTION

The present invention is a system for enhancing the protection capabilities of existing Whipple Shield structures against penetration by hypervelocity impact particles and for enabling greater protection capabilities for new Whipple Shield structures against penetration by hypervelocity impact matter at reduced structural weight and/or stand off (spacing) distances.

In the present invention, layered cloth elements are disposed and located intermediate of the outer bumper wall and the rearward wall. The layered cloth elements include a ceramic cloth disposed in a facing relationship to the bumper wall. "Ceramic cloth" is herein defined as a pliable material made by weaving, felting, embedding or knitting ceramic fibers, threads and/or filaments in to a fabric. "Ceramic" is defined herein as a material composed of metal oxides such as aluminum oxide, silicon dioxide, boron oxide and other metal oxides. The ceramic cloth provides an impact shock layer which has significant strength and flexibility at high temperatures for extended time periods. The purpose of the ceramic cloth is to shock and break up an incoming particle and disperse it in a spray form.

In juxtaposition with the ceramic cloth is a high strength cloth disposed in facing relationship to the rearward wall. A "high strength cloth" is defined herein as a pliable material made by weaving, felting, embedding or knitting high strength/low weight fibers, threads and/or filament. "High strength/low weight" is defined herein as a fiber, thread and/or filament having a specific strength greater than $9\times10^6$ inches (where specific strength=fiber ultimate tensile strength/fiber density) for units of pounds force per square inch divided by pounds (mass) per cubic inch. The high strength cloth provides a capability to disperse for ultimate tensile strength and retard the fragment spray cloud or fragments resulting from penetration of the ceramic cloth before impact with the rearward wall.

In the present invention as set forth herein, a relationship of the design parameters for a Whipple Shield using a blanket barrier comprised of the ceramic cloth and high strength cloth for various critical diameters, velocities and impact angles to be protected against is disclosed in formulae in which the present invention is embodied. The invention is optimized for Whipple Shields having a ratio of stand-off spacing to critical diameter of 15 or less (i.e. relatively short stand-offs).

DESCRIPTION OF THE INVENTION

Figure 1:
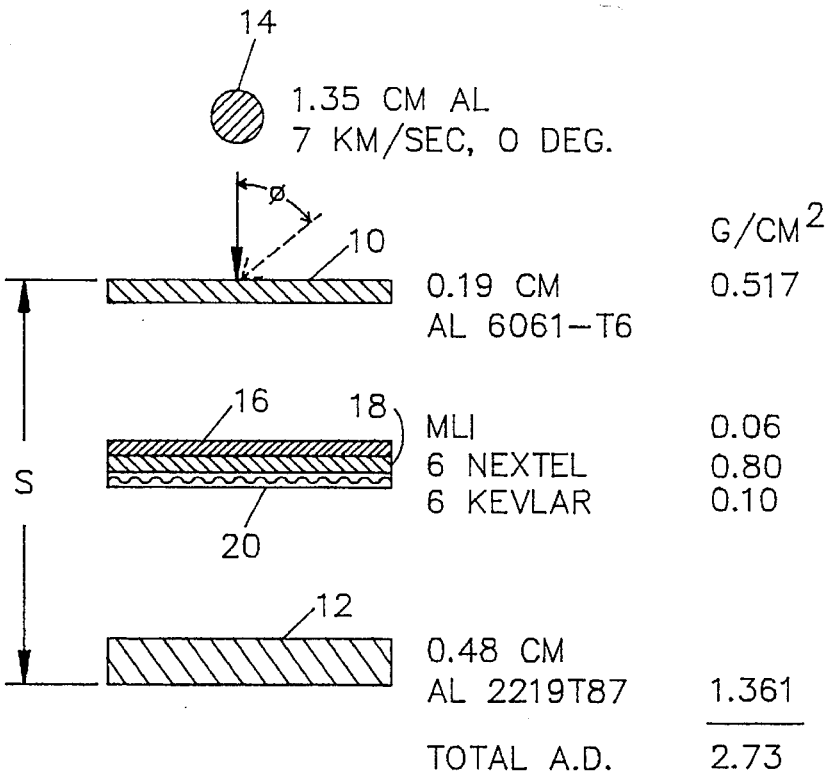
FIG. 1 is a schematic representation of an enhance Whipple Shield of the present invention.

Referring now to FIG. 1, a Whipple Shield embodying the present invention is illustrated in cross-section with a metal bumper or outer wall 10 and with a metal rear wall 12 which is spaced from and parallel to the bumper wall 10. The wall material commonly used in space operations is aluminum, however, it will be appreciated that other metals can be used with the present invention and that other metals are in orbital debris. An impact particle 14 is illustrated at a zero (0°) degree trajectory moving toward the outer bumper wall 10. The impact particle can be at any angle Θ with respect to a normal to the surface of wall 10.

Intermediate of the bumper wall 10 and the rear wall 12 is a layered blanket barrier structure which includes three elements: (1) an outer multi layered insulation (MLI) blanket element 16, (2) an intermediate set of ceramic cloth elements 18 and (3) an inner set of high strength cloth elements. The outer blanket element 16 is an insulation media commonly utilized in space operations and is not essential to the present invention and is only included herein to illustrate an application of the invention to space operations such as the space station. The blanket element 16 is a composite film, which reflects solar energy, maintains internal environment temperatures and may reflect heat and sometimes is referred to as MLI. MLI is available from SHELDAH in Northfield, Minn.

The ceramic cloth elements 18 consist of cloth layers of a ceramic cloth. "Ceramic cloth" as herein defined is a pliable material made by, weaving, felting, embedding, or knitting ceramic fibers, threads and or filaments in to a fabric. "Ceramic" as defined herein is a material composed of metal oxides such as aluminum oxide, silicon dioxide, boron oxide and other metal oxides. The ceramic cloth provides an impact shock layer and is a material having significant strength and flexibility at high temperatures for extended time periods similar to the materials disclosed.

Figure 4:
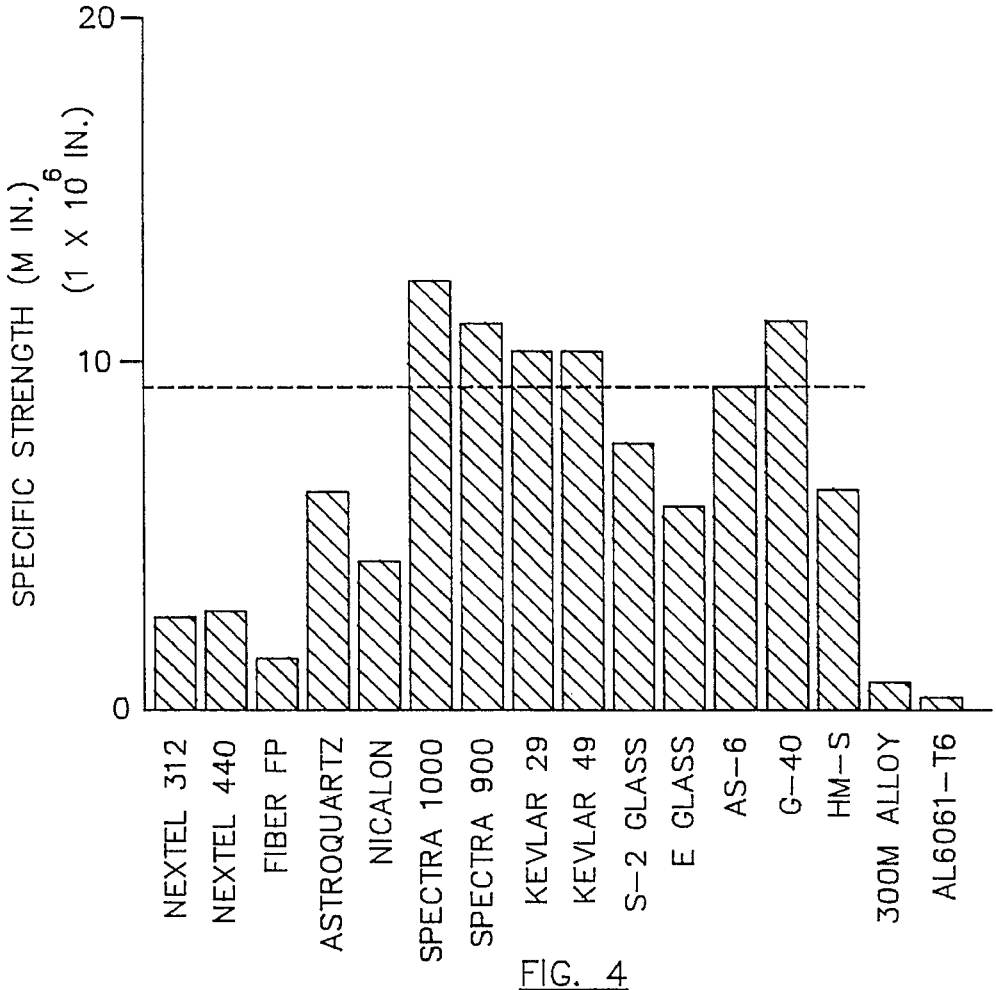
FIG. 4 is a plot of specific strength of various materials.

In juxtaposition with the ceramic cloth is a high strength cloth disposed in facing relationship to the rear wall. A "high strength cloth" as defined herein is a pliable material made by weaving, felting, embedding or knitting high strength/low weight fibers, threads and/or filament. "High strength/low weight" as defined herein is a fiber, thread and/or filament having a specific strength greater than $9\times10^6$ inches (where specific strength=strength/density). The high strength cloth provides the capability to slow down or retard the debris cloud caused by fragments resulting from the penetration of the ceramic cloth before impact with the containment or rear wall. Reference can be made to FIG. 4 which illustrates a chart of specific strength of various materials. Materials suitable for the high strength cloth should have a specific strength of about $9\times10^6$ in. or more. "SPECTRA" cloth made by Allied Signal, Inc. of Petersburg, Va. is suitable. SPECTRA cloth is made from extended chain polyethylene fibers.

The layered MLI blanket, ceramic cloth and high strength cloth are flexible and tests have shown that the relative positioning between the bumper wall and the rear wall does not significantly offset the performance of penetration resistance although the blanket barrier structure is preferably not in contact with either of the walls for optimum performance. The ceramic cloth and high strength cloth are sometimes referred to herein as a blanket barrier.

With respect to FIG. 1, as an example of a practical application, a spacing "S" from the outer surface of the bumper wall 10 to the inner surface of the containment or rear wall 12 is 11.4 cm for a habitable module on a space station. The bumper wall thickness ranges from 0.127 cm to 0.19 cm and is A16061-T6 aluminum. The wall 12 (rear pressure wall) has a wall thickness ranging from 0.32 cm to 0.48 cm and is A12219-T87 aluminum. The ceramic cloth structure 18 consists of six layers of woven threads of AF62 "NEXTEL" ("NEXTEL" is a trademark product available from 3M Ceramic Materials Department). The high strength cloth structure 20 consists of six layers of woven threads of "KEVLAR" 710 ("KEVLAR" is a trademark product available from DuPont). "KEVLAR" style 710 is a dense maximum filling fabric made from 1500 denier KEVLAR 29. As designated in the drawing the areal density of the various components illustrated in FIG. 2 in g/cm$^2$ is as follows:

| | |
|---|---|
| bumper wall | = 0.517 |
| MLI | = 0.06 |
| NEXTEL | = 0.600 |
| KEVLAR | = 0.190 |
| rear wall | = 1.361 |
| TOTAL areal density | 2.728 g/cm$^2$. |

The number of layers of ceramic cloth and high strength cloth or their thickness can vary according to the areal density desired. For example, the rear wall member (tw) can be selected so that the combined weight of the barrier blanket ($m_b$) and the selected rear well is less than or equal to the weight of a rear wall member with a greater thickness as required to protect an un-enhanced Whipple Shield.

Figure 2:
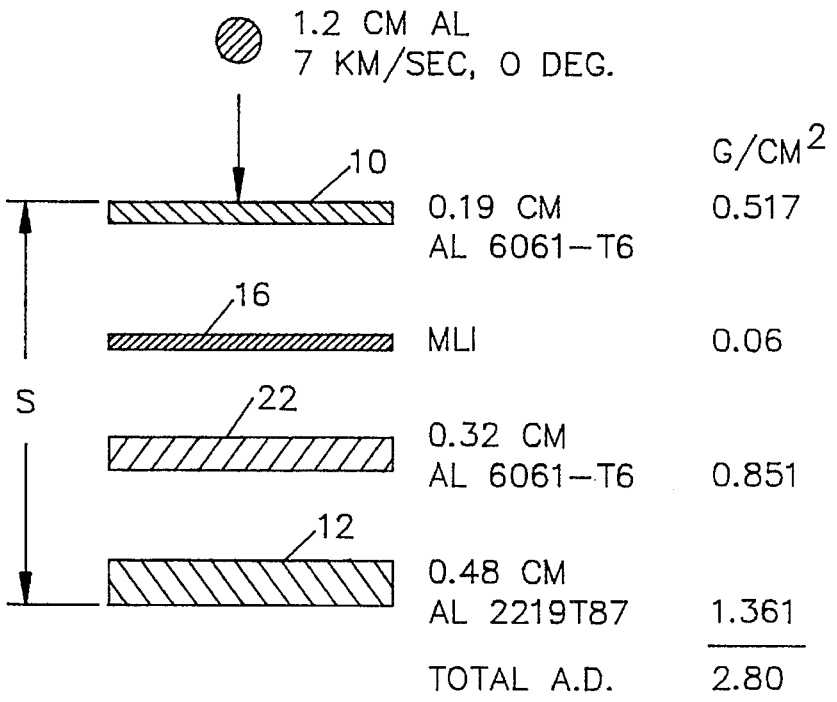
FIG. 2 is a schematic representation of an optimum double walled Whipple Shield for purposes of comparison performance to the present invention.

To illustrate the significance of the present invention comparative tests were conducted with various other Whipple Shield configurations. The best configuration of other Whipple Shields in testing was a Whipple Shield as shown in FIG. 2 where an aluminum intermediate bumper wall 22 had a thickness of 0.32 cm and was disposed between the primary bumper wall and the rear wall 12. All other dimensions were similar to FIG. 1 and the total areal density was 2.80 g/cm$^2$ as compared to 2.728 g/cm$^2$ for the structure illustrated in FIG. 1.

Figure 3:
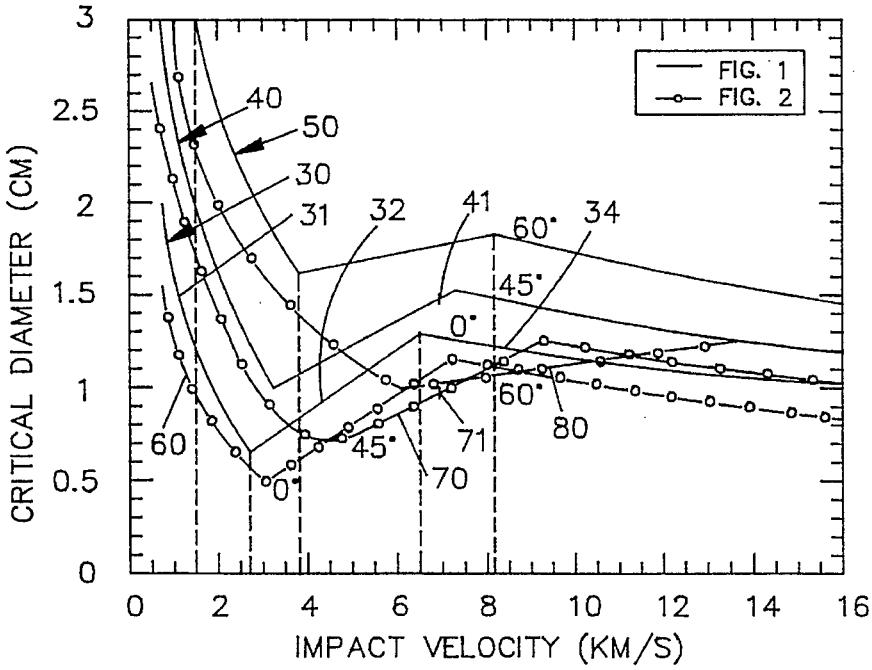
FIG. 3 is a plot of critical diameter as a function of impact velocity for the devices of FIG. 2 and FIG. 3.

Tests were conducted with light-gas guns and shaped charges with respect to the structures shown in FIG. 1 and FIG. 2 for an aluminum particle and the protection against penetration was plotted in terms of critical particle diameter as a function of impact velocity and impact angle as shown in FIG. 3. Critical particle diameter is the diameter of a particle which, at a given impact velocity, will just penetrate the containment wall 12. Particles with diameter less that the critical diameter will not penetrate through the containment wall 12 at a given impact velocity and impact angle. As shown in FIG. 3, for 0° (or direct impact), there is a curve 30 which includes: a curve portion 31 in a low velocity range from about 0.5 km/s to 2.7 km/s where the critical diameter decreases as a function of increasing impact velocity; a curve portion 32 in an intermediate velocity range from 2.7 km/s to 6.5 km/s where the critical diameter increases as a function of increasing impact velocity; and a curve portion 34 in a high velocity range above 6.5 km/s where the critical diameter decreases as a function of increasing impact velocity. In generalities, in the low velocity range the critical object size can vary from a velocity of 0.5 km/s for a particle with a critical diameter of 2 cm to a velocity of 2.7 km/s for a particle with a critical diameter of 0.7 cm.

Tests also established that at different impact angles Θ for 45° and 60° relative to the plane of the wall that the relationship of critical diameter and impact velocity can be plotted and correlated to the 0° direct impact values and the curves 40 and 50 are plotted for impact angles of 45° and 90°.

Appropriate values for the range of curve positions for the various curves 30, 40 and 50 are as follows:

| Θ | low velocity (km/s) | critical diameter (cm) | intermediate velocity (km/s) | critical diameter (cm) | high velocity (km/s) | critical diameter (cm) |
|---|---|---|---|---|---|---|
| 0 | .5–2.7 | 1.8–0.6 | 2.7–6.5 | 0.6–1.6 | 6.5–16 | 1.3–1.1 |
| 45° | .8–3.2 | 3–1.0 | 3.2–7.9 | 1.0–1.58 | 7.9–16 | 1.58–1.2 |
| 60° | 1.5–3.9 | 3–1.6 | 3.9–8.1 | 1.6–1.8 | 8.1–16 | 1.8–1.45 |

Similar tests conducted on the configuration shown in FIG. 2 developed data for curves 60, 70, and 80 for the various angle Θ of 0°, 45° and 60°. As shown in FIG. 3, it can be seen from the general characteristics of all of the curves that a Whipple Shield embodying the present invention clearly out performs the next best alternative of FIG. 2 for a given particle material.

Approximate values for the range of curve positions for the various curves 60, 70 and 80 are as follows:

| Θ | low velocity (km/s) | critical diameter (cm) | intermediate velocity (km/s) | critical diameter (cm) | high velocity (km/s) | critical diameter (cm) |
|---|---|---|---|---|---|---|
| 0 | 0.5–3.0 | 1.6–0.51 | 3.0–7.0 | 0.51–1.2 | 7.0–16 | 1.2–0.8 |
| 45° | 0.5–4.2 | 2.8–0.7 | 4.2–10 | 0.7–1.2 | 10–16 | 1.2–1.0 |
| 60° | 1.0–6.0 | 3.0–1.0 | 6.0–14.0 | 1.0–1.3 | 14–16 | 1.3–1.2 |

With respect to FIG. 3, it can be appreciated that each impact curve 30, 40, 50 has a low velocity range, an intermediate velocity range and a high velocity range.

The design parameters for a Whipple Shield with a blanket barrier of the present invention can be defined for the low velocity range in terms of a critical diameter and impact velocity for a given material by the following relationship:

Low-Velocity Equation for $$V \leqq 2.7/(\cos\Theta)^{0.5}: \ldots \quad (1)$$

Then:

$$d_c = 2\,[t_w(\sigma/40)^{0.5} + 0.37 m_b]/[\cos\Theta)^{5/3}\delta_p^{0.5}V^{2/3}]\ldots \quad (2)$$

where the parameters are d Particle diameter (cm)

$d_c$ Minimum particle diameter causing failure; i.e., "critical" particle that just results in complete penetration of the shield's rear wall or containment wall 12 of FIG. 1 (cm)

δ Density (g/cc)

m Areal density (g/cm$^2$)

σ Containment wall 12 yield stress (ksi)

t Thickness (cm)

Θ Impact angle measured from surface normal (deg)

V Particle impact velocity (km/sec)

Subscripts:

b All bumpers and intermediate layers p Particle w Rear wall or Containment wall 12 of FIG. 1

With Equations 1 and 2, for a given size and material impact particle, velocity and impact angle, a Whipple Shield with a barrier blanket can be designed with the design parameters as desired. Conversely, for an given Whipple Shield incorporating the present invention, the protection afforded by the shield can be analyzed to determine its protection performance characteristics.

The design parameters for a Whipple Shield with a blanket barrier of the present invention can be defined for the intermediate velocity range in terms of critical diameter and impact velocity for a given particle material by the following relationship:

Intermediate Velocity Equation $$\text{for } 2.7/(\cos\Theta)^{0.5} < V < 6.5/(\cos\Theta)^{1/3}: \quad (3)$$

then:

$$d_c = 1.031\,\delta_p^{-0.5}\,[t_w(\sigma/40)^{0.5} + 0.37\,m_b]\,(\cos\Theta)^{-4/3}\,[(6.5/(\cos\Theta)^{1/3} - V)/(6.5/(\cos\Theta)^{1/3} - 2.7/(\cos\Theta)^{0.5})] + 0.321\,(t_w\,\delta_w)^{1/3}\,\delta_p^{-1/3}\,(\cos\Theta)^{-7/18}\,S^{2/3}\,(\sigma/40)^{1/6}\,[(V - 2.7/\cos\Theta)^{0.5})/(6.5/(\cos\Theta)^{1/3} - 2.7/(\cos\Theta)^{0.5})] \quad (4)$$

where the parameter

S Overall spacing from the front of outer bumper to the back of rear wall (cm)

With Equations 3 and 4 for a given size and material impact particle, velocity and impact angle, the Whipple Shield can be designed with the desired design parameters for intermediate velocity projectiles. Conversely, a given Whipple Shield incorporating the present invention can be analyzed to determine its protection performance characteristics.

The design parameters for a Whipple Shield with a blanket barrier of the present invention can be defined for the high velocity range in terms of a critical diameter and impact velocity for a given particle material by the following relationship:

High-Velocity Equation for $$V \geqq 6.5/(\cos\Theta)^{1/3}: \ldots \quad (5)$$

then:

$$d_c = 0.6(t_w\delta_w)^{1/3}\delta_p^{-1/3}V^{-1/3}(\cos\Theta)^{-1/4}S^{2/3}(\sigma/40)^{1/6}\ldots \quad (6)$$

With Equations 5 and 6, for a given size and material impact particle, velocity and impact angle, the Whipple Shield can be designed with the desired design parameters for a high velocity projectile. Conversely, a given Whipple Shield incorporating the present invention can be analyzed to determine its performance characteristic.

The present invention which provides an intermediate blanket barrier enhances the protection performance of existing Whipple Shields with relatively short standoffs or wall spacing. The blanket barrier has great protection effectiveness as compared to a solid-aluminum second bumper of equal mass per unit area as shown in FIG. 2. The ceramic cloth is more effective than an aluminum barrier at shocking and disrupting fragments of the impact object and the bumper wall. The high strength cloth has a greater strength to weight ratio than aluminum and provides superior capability to slow the expansion speed of the debris cloud before impact with the inner wall of the shield. The blanket barrier of the present invention also upon impact produces short fibers of low density and low size that are less damaging to the container wall 12 in FIG. 1 as compared to large aluminum metal fragments produced by an aluminum barrier.

The data providing the basis for formulating ballistic limit equations 1–6 that define the maximum particle size that a blanket barrier Whipple Shield is capable of protecting against as a function of projectile velocity includes the various parameters noted above. These equations are useful for assessments of meteorold/orbital debris penetration probability for spacecraft protected by the blanket barrier Whipple Shield. The equations are also useful to size shields for a given and/or desired protection level.

Tests using light-gas guns (LGG), shaped-charge launcher (SCL), and SNL hypervelocity launcher (HVL), all indicate that the barrier Whipple Shield provides better protection than an aluminum double-bumper shield of equivalent weight.

In the comparison of the ballistic limit curves for a double bumper shield and the present invention as given in FIG. 3, the data indicates that the aluminum double-bumper shield at a 45° impact angle will protect against a 0.98 cm particle at 7 km/sec (point 71) while the blanket barrier in a Whipple Shield can protect against a 1.54 cm aluminum projectile at the same impact conditions (point 41). This is a clear indication that the blanket barrier Whipple Shield stops particles with about 3 times greater mass than the aluminum shield 22 at these impact conditions.

In other tests, we have established that the rear wall of an aluminum shield was completely perforated by a 1 g shaped charge projectile at 11 km/sec and a 45° impact angle while the rear wall of a Whipple Shield having a blanket barrier was not penetrated by a 1.5 g SCL projectile (50% heavier). A shaped-charge particle diameter was calculated assuming a sphere with an equivalent mass to that measured for the cylindrically configured shaped-charge projectile. Shaped-charge data collected indicates the blanket barrier Whipple Shield ballistic limit curves are conservative at high velocities. In addition, tests on the all-aluminum shield of FIG. 2 failed the shield's rear wall 12 while tests under similar impact conditions on the barrier Whipple Shield did not fail the rear wall 12. This relative performance advantage for blanket barrier in the Whipple Shields compared to all-aluminum barrier is shown in the comparison below.

| Shield Type | Impact Angle | Proj. Mass (g) | Proj. Velocity (km/sec) | Test Results |
|---|---|---|---|---|
| All-Al | 0 | 0.84 | 11.03 | Shield FAILED |

-continued

| Shield Type | Impact Angle | Proj. Mass (g) | Proj. Velocity (km/sec) | Test Results |
|---|---|---|---|---|
| Barrier | 0 | 0.87 | 11.18 | NO-FAIL |
| All-AL | 45 | 1.04 | 11.33 | Shield FAILED |
| ALL-Al | 45 | 1.12 | 11.32 | Shield FAILED |
| Barrier | 45 | 1.02 | 11.14 | NO-FAILURE |
| All-Al | 45 | 1.56 | 11.42 | Shield FAILED |
| Barrier | 45 | 1.52 | 11.42 | NO-FAILURE |

Using ballistic limit equations for Whipple Shields and supporting data, a Whipple Shield would weigh about 2–3 times more than the barrier Whipple Shield of the present invention for protecting from 1.4 cm diameter aluminum projectile at 7 km/sec with a 11 cm standoff.

The blanket barrier in the Whipple Shield of the present invention using fabric cloth blanket as the intermediate bumper (i.e., second bumper) represents an innovative, low-weight technique to provide protection when spacing is constrained (for example, when $S/d_c<15$ for V=6.5 km/sec & 0° normal impact).

The blanket barrier in a Whipple Shield provides better protection than double-aluminum bumper shields of equal weight (by stopping 50% to 300% more massive particles). Shield performance is improved (compared to aluminum) because ceramic fabric is better at shocking projectile fragments than aluminum, and high strength fabric is better at slowing debris cloud expansion than aluminum. In addition, the fragments of bumper materials within the debris cloud ("secondaries") are smaller for cloth bumpers than aluminum, which results in less rear wall damage compared to the larger fragments produced by aluminum bumpers.

The ballistic limit equations 1–6 define performance of blanket barriers for Whipple Shield configurations and these equations are based on extensive test and analysis results.

It will be apparent to those skilled in the art that various changes may be made in the invention without departing from the spirit and scope thereof and therefore the invention is not limited by that which is disclosed in the drawings and specifications but only as indicated in the appended claims.

We claim:

1. An enhanced hypervelocity Whipple Shield for protecting a wall member from penetration by impact particles having interrelated factors of velocity and critical diameter where a critical diameter is the minimum diameter of a particle which would just penetrate the wall member at a given density and velocity and impact angle, said shield comprising:

a wall member and a bumper wall member constructed from a selected metal material and respectively having a wall thickness and spacing from one another for dissipating the energy developed by a high velocity impact of a particle of a selected metal material where the particle has a first critical diameter and velocity and for preventing penetration of the wall member;

a flexible barrier blanket disposed intermediate of said bumper wall member and said wall member, said blanket barrier including a ceramic cloth facing said bumper wall member for shocking fragments of a particle penetrating said bumper wall member and having a high strength cloth facing said wall member for retarding the fragments penetrating said ceramic cloth whereby said Whipple Shield can withstand high velocity impact particles of said selected metal material at critical diameters and velocities greater than said first critical diameter and velocity; and wherein the critical diameter and velocity are interrelated for velocities less than $2.7/(\cos\Theta)^{0.5}$ by the following relationship of parameters $$d_c=2[t_w(\sigma/40)^{0.5}+0.37m_b]/[(\cos\Theta)^{5/3}\delta p^{0.5}V^{2/3}]$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

Σ Rear wall yield stress (ksi)

t Thickness (cm)

Θ Impact angle measured from surface normal (deg)

V Particle impact velocity (km/sec)

and where the Subscripts are:

b All bumpers and intermediate layers p Particle w Rear wall.

2. A hypervelocity Whipple Shield for protecting a wall member from penetration by impact particles having interrelated factors of velocity and critical diameter where a critical diameter is the diameter of a fragment which would penetrate the wall member at a given velocity, said shield comprising:

a wall member and a bumper wall member constructed from a selected metal material and respectively having a wall thickness and spacing from one another for dissipating the energy developed by a high velocity impact of a particle of a selected metal material where the particle has a first critical diameter and velocity and for preventing penetration of the wall member;

a flexible barrier blanket disposed intermediate of said bumper wall member and said wall member, said blanket barrier including a ceramic cloth facing said bumper wall member for shocking fragments of a particle penetrating said bumper wall member and having a high strength cloth facing said wall member for retarding the fragments penetrating said ceramic cloth whereby said Whipple Shield can withstand high velocity impact particles of said selected metal material at critical diameters and velocities greater than said first critical diameter and velocity; and wherein the critical diameter and velocity are interrelated for velocities between $2.7/(\cos\Theta)^{0.5}$ and less than $6.5/(\cos\Theta)^{1/3}$ by the following relationship of parameters $$d_c = 1.031\ \delta_p^{-0.5}\ [t_w(\sigma/40)^{0.5} + 0.37\ m_b]\ (\cos\Theta)^{-4/3}\ [(6.5/(\cos\Theta)^{1/3} - V)/(6.5/(\cos\Theta)^{1/3} - 2.7/(\cos\Theta)^{0.5})] + 0.321\ (t_w\ \delta_w)^{1/3}\ \delta_p^{-1/3}\ (\cos\Theta)^{-7/18}\ S^{2/3}\ (\sigma/40)^{1/6}\ [(V - 2.7/\cos\Theta)^{0.5})/(6.5/(\cos\Theta)^{1/3} - 2.7/(\cos\Theta)^{0.5})]$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

Σ Rear wall yield stress (ksi)

t Thickness (cm)

Θ Impact angle measured from surface normal (deg)

V Particle impact velocity (km/sec)

S Overall spacing from the front of outer bumper to the back of rear wall (cm)

and where the Subscripts are:

b All bumpers and intermediate layers p Particle w Rear wall.

3. An enhanced hypervelocity Whipple Shield for protecting a wall member from penetration by impact particles having interrelated factors of velocity and critical diameter where a critical diameter is the minimum diameter of a particle which would just penetrate the wall member at a given density and velocity and impact angle, said shield comprising:

a wall member and a bumper wall member constructed from a selected metal material and respectively having a wall thickness and spacing from one another for dissipating the energy developed by a high velocity impact of a particle of a selected metal material where the particle has a first critical diameter and velocity and for preventing penetration of the wall member;

a flexible barrier blanket disposed intermediate of said bumper wall member and said wall member, said blanket barrier including a ceramic cloth facing said bumper wall member for shocking fragments of a particle penetrating said bumper wall member and having a high strength cloth facing said wall member for retarding the fragments penetrating said ceramic cloth whereby said Whipple Shield can withstand high velocity impact particles of said selected metal material at critical diameters and velocities greater than said first critical diameter and velocity; and wherein the critical diameter and velocity are interrelated for velocities greater than $6.5/(\cos\Theta)^{1/3}$ by the following relationship of parameters $$d_c=0.6(t_w\delta_w)^{1/3}\delta_p^{-1/2}V^{-1/2}(\cos\Theta)^{-1/2}S^{2/3}(\sigma/40)^{1/6}$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

σ Rear wall yield stress (ksi)

t Thickness (cm)

Θ Impact angle measured from surface normal (deg)

V Particle impact velocity (km/sec)

S Overall spacing from the front of outer bumper to the back of rear wall (cm)

and where the Subscripts are:

b All bumpers and intermediate layers p Particle w Rear wall.

4. A method for constructing a lower weight, enhanced hypervelocity Whipple Shield for protecting a rear wall member from penetration by impact particles having interrelated factors of velocity and critical diameter where a critical diameter is the minimum diameter of a particle of a given material which would just penetrate the rear wall member at a given density and velocity and impact angle, said method comprising the steps off selecting a first critical diameter and velocity of a hypervelocity particle which should be prevented from penetrating the rear wall member of the enhanced Whipple Shield having a bumper wall spaced from the rear wall;

selecting a wall thickness for the rear wall member and the bumper wall member for a selected metal material and defining the spacing from one another for dissipating the energy upon penetration of the bumper wall member and determining the critical diameter and velocity of a hypervelocity particle of a selected metal material which would penetrate the rear wall member of a basic (un-enhanced) Whipple Shield;

constructing a flexible barrier blanket to be disposed intermediate of said bumper wall member and said rear wall member where said blanket barrier includes a ceramic cloth facing said bumper wall member for shocking fragments of a particle penetrating said bumper wall member and has a high strength cloth facing said rear wall member for retarding the fragments penetrating said ceramic cloth so that said enhanced Whipple Shield can withstand said first critical diameter and velocity of such hypervelocity particles; and disposing said blanket barrier intermediate of said bumper wall and said rear wall member.

5. The method as set forth in claim 4 wherein the critical diameter and velocity are interrelated for velocities less than $2.7/(\cos\Theta)^{0.5}$ by the following relationship of parameters $$d_c=2\,[t_w(\sigma/40)^{0.5}+0.37m_b]/[(\cos\Theta)^{5/3}\delta_p^{0.5}V^{2/3}]$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

$\sigma$ Rear wall yield stress (ksi)

t Thickness (cm)

$\Theta$ Impact angle measured from surface normal (deg)

V Particle impact velocity (km/sec)

and where the Subscripts are:

b All bumpers and intermediate layers p Particle w Rear wall.

6. The method as set forth in claim 4 wherein the critical diameter and velocity are interrelated for velocities between $2.7/(\cos\Theta)^{0.5}$ and less than $6.5/(\cos\Theta)^{1/3}$ by the following relationship of parameters $$d_c = 1.031\,\delta_p^{-0.5}\,[t_w(\sigma/40)^{0.5} + 0.37\,m_b]\,(\cos\Theta)^{-4/3}\,[(6.5/(\cos\Theta)^{1/3} - V)/(6.5/(\cos\Theta)^{1/3} - 2.7/(\cos\Theta)^{0.5})] + 0.321\,(t_w\,\delta_w)^{1/3}\,\delta_p^{-1/3}\,(\cos\Theta)^{-7/18}\,S^{2/3}\,(\sigma/40)^{1/6}\,[(V - 2.7/\cos\Theta)^{0.5})/(6.5/(\cos\Theta)^{1/3} - 2.7/(\cos\Theta)^{0.5})]$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

$\sigma$ Rear wall yield stress (ksi)

t Thickness (cm)

$\Theta$ Impact angle measured from surface normal (deg)

V Particle impact velocity (km/sec)

S Overall spacing from the front of outer bumper to the back of rear wall (cm)

and where the Subscripts are:

b All bumpers and intermediate layers p Particle w Rear wall.

7. The method as set forth in claim 4 wherein the critical diameter and velocity are interrelated for velocities greater than $6.5/(\cos\Theta)^{1/3}$) by the following relationship of parameters $$d_c=0.6(t_w\delta_w)^{1/3}\delta_p^{-1/3}V^{-1/3}(\cos\Theta)^{-1/3}S^{2/3}(\sigma/40)^{1/6}$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

$\sigma$ Rear wall yield stress (ksi)

t Thickness (cm)

$\Theta$ Impact angle measured from surface normal (deg)

V Particle impact velocity (km/sec)

S Overall spacing from the front of outer bumper to the back of rear wall (cm)

and where the Subscripts are:

b All bumpers and intermediate layers p Particle w Rear wall.

8. A method for modifying a hypervelocity Whipple Shield to result in an enhanced Whipple Shield with the same or less shield weight to increase the resistance to penetration by impact particles having interrelated factors of velocity, impact angle and critical diameter where a critical diameter is the minimum particle diameter of a given particle material which would just penetrate a rear wall member at a given velocity and impact angle, said method comprising the steps of:

selecting a first critical diameter, velocity and impact angle of a hypervelocity particle which should be prevented from penetrating a rear wall member of an enhanced Whipple Shield which also has a bumper wall spaced from the rear wall member;

selecting a wall thickness for the rear wall member and the bumper wall member for selected metal materials and defining the spacing from one another for dissipating the energy upon penetration of the bumper wall member so that the said first critical diameter, velocity and impact angle of a hypervelocity particle of a selected metal material would just penetrate the rear wall member of this basic (un-enhanced) Whipple Shield:

constructing a flexible barrier blanket to be disposed intermediate of said bumper wall member and said rear wall member where said barrier blanket includes a ceramic cloth facing said bumper wall member for shocking fragments of a particle penetrating said bumper wall member and has a high strength cloth facing said rear wall member for retarding the fragments penetrating said ceramic cloth;

selecting a second reduced thickness for the rear wall member such that the combined weight of the said barrier blanket and the said second rear wall member is less than or equal to the weight of the first rear wall member, so that said enhanced Whipple Shield can withstand said first critical diameter, velocity and impact angle of such hypervelocity particles; and disposing said blanket barrier intermediate of said bumper wall member and said second rear wall member.

9. The method as set forth in claim 8 wherein the critical diameter and velocity are interrelated for velocities less than $2.7/(\cos\Theta)^{0.5}$ by the following relationship of parameters $$d_c=2\,[t_w(\sigma/40)^{0.5}+0.37m_b]/[(\cos\Theta)^{5/3}\delta_p^{0.5}V^{2/3}]$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

$\sigma$ Rear wall yield stress (ksi)

t Thickness (cm)

$\Theta$ Impact angle measured from surface normal (deg)

V Particle impact velocity (km/sec)

and where the Subscripts are:

b All bumpers and intermediate layers p Particle w Rear wall.

10. The method as set forth in claim 8 wherein the critical diameter and velocity are interrelated for velocities between $2.7/(\cos\Theta)^{0.5}$ and less than $6.5/(\cos\Theta)^{1/3}$ by the following relationship of parameters $$d_c = 1.031\,\delta_p^{-0.5}\,[t_w(\sigma/40)^{0.5} + 0.37\,m_b]\,(\cos\Theta)^{-4/3}\,[(6.5/(\cos\Theta)^{1/3} - V)/(6.5/(\cos\Theta)^{1/3} - 2.7/(\cos\Theta)^{0.5})] + 0.321\,(t_w\,\delta_w)^{1/3}\,\delta_p^{-1/3}\,(\cos\Theta)^{-7/18}\,S^{2/3}\,(\sigma/40)^{1/6}\,[(V - 2.7/\cos\Theta)^{0.5})/(6.5/(\cos\Theta)^{1/3} - 2.7/(\cos\Theta)^{0.5})]$$

where the parameter where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

$\sigma$ Rear wall yield stress (ksi)

t Thickness (cm)

$\Theta$ Impact angle measured from surface normal (deg)

V Particle impact velocity (km/sec)

S Overall spacing from the front of outer bumper to the back of rear wall (cm)

and where the Subscripts are:

b All bumpers and intermediate layers p Particle w Rear wall.

11. The method as set forth in claim 8 wherein the critical diameter and velocity are interrelated for velocities greater than $6.5/(\cos\Theta)^{1/3}$ by the following relationship of parameters $$d_c=0.6(t_w\delta_w)^{1/3}\delta_p^{-1/3}V^{-1/3}(\cos\Theta)^{-7/6}S^{2/3}(\sigma/40)^{1/6}$$

where the parameters are defined as follows:

d Particle diameter (cm)

$d_c$ Minimum particle diameter causing failure; i.e., "critical" particle that just results in complete penetration of the shield's rear wall (cm)

$\delta_p$ Density (g/cc)

m Areal density (g/cm$^2$)

$\sigma$ Rear wall yield stress (ksi)

t Thickness (cm)

$\Theta$ Impact angle measured from surface normal (deg)

V Particle impact velocity (km/sec)

S Overall spacing from the front of outer bumper to the back of rear wall (cm)

and where the Subscripts are:

b All bumpers and intermediate layers p Particle w Rear wall.

12. An enhanced hypervelocity Whipple Shield for protecting a wall member in the enhanced Whipple Shield from penetration by impact particles having a velocity ($v_e$) and critical diameter ($d_e$) greater than a velocity ($v_u$) and critical diameter ($d_u$) at which impact particles would normally penetrate an unenhanced Whipple Shield, where such critical diameter ($d_u$) of such an impact particle is the minimum diameter of such particle which would just penetrate the wall member for a given density, velocity ($v_u$) and impact angle of such particle, said enhanced Whipple Shield comprising:

a rear wall member and a first bumper wall member constructed from selected metal materials and respectively having a wall thickness and spacing from one another for dissipating the energy developed by a high velocity impact of such particle of a selected material at said velocity ($v_u$) and critical diameter ($d_u$):

a flexible barrier blanket disposed in the space intermediate of said bumper wall member and said rear wall member, said blanket barrier including a ceramic cloth which acts as a second bumper wall member and faces said first bumper wall member for shocking fragments of such a particle penetrating said first bumper wall member, and said barrier blanket also having a high strength cloth facing said rear wall member for retarding the fragments penetrating said ceramic cloth whereby said enhanced Whipple Shield can withstand high velocity impact of such particles of such selected material at said velocities ($v_e$) and diameters ($d_c$) greater than the velocity ($v_u$) and diameters ($d_u$) without penetration of the rear wall member; and said Whipple Shield having a ratio of the spacing between the rear member and the second bumper wall member to said critical diameter ($d_u$) of 15 or less.

13. The apparatus as set forth in claim 12 wherein said ceramic cloth is comprised of metal oxides having high impact resistance at high temperatures.

14. The apparatus as set forth in claim 12 wherein said high strength cloth is comprised of a pliable material which has a specific strength greater than $9\times10^6$ inches.

15. The apparatus as set forth in claim 12 wherein said ceramic cloth is comprised of fibers of metal oxides having high impact resistance at high temperatures and said high strength cloth is comprised of a pliable material which has a specific strength greater than $9\times10^6$ inches.

16. The apparatus as set forth in claim 15 wherein said ceramic cloth is aluminum oxide, silicon dioxide or boron dioxide.

17. The apparatus as set forth in claim 15 wherein said high strength cloth is made from Spectra™ or Kevlar™ fibers.

18. The apparatus as set forth in claim 15 wherein said ceramic cloth is comprised of fibers of aluminum oxide, silicon dioxide or boron dioxide and wherein said high strength cloth is comprised of fibers of Spectra™ or Kevlar™ material.

19. The apparatus as set forth in claim 15 wherein said ceramic cloth is made from Nextel™ fibers.

20. The apparatus as set forth in claim 12 wherein the layers of said ceramic cloth member are comprised of fibers of metal oxides having impact resistance at high temperatures and wherein the layers of said high strength cloth member are comprised of a pliable material which has a specific strength greater than $9\times10^6$ inches.

21. The apparatus as set forth in claim 20 wherein said ceramic cloth member is comprised of fibers of aluminum oxide, silicon dioxide or boron dioxide and wherein said high strength cloth member is comprised of fibers of Spectra® or Kevlar® material.

22. A method for modifying a hypervelocity Whipple Shield to result in an enhanced Whipple Shield with the same or less shield weight to increase the resistance to penetration by impact particles having interrelated factors of velocity, impact angle and critical diameter, where a critical diameter is the minimum particle diameter of a given particle material which would just penetrate a rear wall member at a given velocity and impact angle, said method comprising the steps of:

selecting a first critical diameter, velocity and impact angle of a hypervelocity particle which should be prevented from penetrating a first rear wall member of an enhanced Whipple Shield which has a bumper wall member at a location spaced from the first rear wall member;

selecting a wall thickness for the first rear wall member and the bumper wall member for selected metal materials and defining the spacing from one another for dissipating the energy upon penetration of the bumper wall member so that said first critical diameter, velocity and impact angle of a hypervelocity particle of a selected metal material would just penetrate the first rear wall member of this unenhanced Whipple Shield;

constructing a flexible barrier blanket to be disposed intermediate said bumper wall member and said first rear wall member where said barrier blanket includes a ceramic cloth member facing said bumper wall member for shocking fragments of a particle penetrating said bumper wall member, said ceramic cloth member being comprised of layers of woven fibers of metal oxides having impact resistance at high temperatures, said barrier blanket further including a high strength cloth member facing said rear wall member for retarding the fragments penetrating said ceramic cloth member, said high strength cloth member being comprised of layers of fibers which have a specific strength greater than $9\times10^6$ inches;

substituting a second rear wall with a reduced wall thickness relative to the first rear wall member such that the combined weight of said barrier blanket and said second rear wall member is less than or equal to the weight of said first rear wall member, so that said enhanced Whipple Shield can withstand said first critical diameter, velocity and impact angle of such hypervelocity particles; and disposing said barrier blanket intermediate of said bumper wall member and said substituted second rear wall member.

* * * * *